US008033782B2

(12) United States Patent
Tapper

(10) Patent No.: US 8,033,782 B2
(45) Date of Patent: Oct. 11, 2011

(54) METHOD TO PREVENT BRINELLING WEAR OF SLOT AND PIN ASSEMBLY

(75) Inventor: Kevin L. Tapper, Greensburg, PA (US)

(73) Assignee: Elliott Company, Jeannette, PA (US)

( * ) Notice: Subject to any disclaimer, the term of this patent is extended or adjusted under 35 U.S.C. 154(b) by 939 days.

(21) Appl. No.: 12/014,978

(22) Filed: Jan. 16, 2008

(65) Prior Publication Data

US 2009/0180858 A1 Jul. 16, 2009

(51) Int. Cl.
*F04D 27/02* (2006.01)

(52) U.S. Cl. ..... 415/1; 415/159; 415/202

(58) Field of Classification Search ..... 415/1, 159, 415/160, 165, 202, 208.2, 208.3, 209.2, 209.4, 415/211.1
See application file for complete search history.

(56) References Cited

U.S. PATENT DOCUMENTS 3,042,370 A * 7/1962 Welsh ..... 415/209.4
3,407,681 A 10/1968 Kiernan et al.
3,674,377 A 7/1972 Trappmann
4,050,844 A 9/1977 Miller et al.
4,195,964 A 4/1980 Kraft et al.
4,657,481 A 4/1987 Mowill et al.
4,695,220 A 9/1987 Dawson
4,726,744 A * 2/1988 Arnold ..... 417/407
4,773,821 A 9/1988 Gonthier et al.
4,810,164 A 3/1989 Wright
4,834,613 A 5/1989 Hansen et al.
4,836,747 A 6/1989 Hotz
4,844,690 A * 7/1989 DeLaurier et al. ..... 415/148
5,024,580 A 6/1991 Olive
5,141,394 A 8/1992 Donlan
5,224,820 A 7/1993 Brichet et al.
5,518,365 A 5/1996 Baets et al.
5,593,275 A 1/1997 Venkatasubbu et al.
5,921,749 A * 7/1999 McLaurin et al. ..... 415/189
6,450,763 B1 9/2002 Crum et al.
6,688,846 B2 2/2004 Caubet et al.
7,011,494 B2 3/2006 Kies et al.
7,104,754 B2 9/2006 Willshee et al.
7,198,454 B2 * 4/2007 Evans ..... 415/12
7,220,098 B2 5/2007 Bruce et al.
7,223,066 B2 * 5/2007 Rockley ..... 415/160
7,520,716 B2 * 4/2009 Tacconelli et al. ..... 415/148
2002/0034439 A1 3/2002 Caubet et al.
2005/0271502 A1 12/2005 Burgmeier et al.
2010/0172745 A1 * 7/2010 Hodder ..... 415/163

* cited by examiner

*Primary Examiner* — Edward Look
*Assistant Examiner* — Andrew C Knopp
(74) *Attorney, Agent, or Firm* — The Webb Law Firm

(57) ABSTRACT

A method to prevent brinelling wear of a slot and pin assembly of an adjustable inlet guide vane mechanism includes: providing a compressor having the adjustable inlet guide vane mechanism including a control ring with a plurality of tapered slots positioned around a circumference of the control ring; providing a plurality of tapered pin/lever arm assemblies each comprising a tapered pin having a tapered body with a first end and a second end; positioning the tapered pin of the tapered pin/lever arm assembly within each of the plurality of tapered slots; positioning a spring over the first end of each of the tapered pins; and securing the tapered pin of each of the tapered pin/lever arm assemblies within each of the tapered slots by coupling a fastening member to the first end of each of the tapered pins.

17 Claims, 4 Drawing Sheets

METHOD TO PREVENT BRINELLING WEAR OF SLOT AND PIN ASSEMBLY

BACKGROUND OF THE INVENTION

1. Field of the Invention

The present invention relates, in general, to an adjustable inlet guide vane mechanism for a compressor and, more particularly, to a method of preventing wear of a slot and pin assembly of such an adjustable inlet guide vane mechanism.

2. Description of Related Art

An adjustable inlet guide vane mechanism for a compressor typically includes a plurality of circumferentially arranged vanes, a plurality of operating levers and a control ring. Each operating lever is pivotally mounted at a first end to the control ring by a pin positioned within a slot of the control ring, and each operating lever is mounted at a second end to one of the vanes. Rotation of the control ring causes the levers to adjust the angular position of the vanes.

The slots of the control ring and the pin have typically been machined with straight walls such that a space exists between them when the pin is positioned within the slot. This space exists due to the accuracy of the machining of the slots of the control ring and the pin and for purposes of assembly. This space allows for vibrations between the pin and the slot during operation of the compressor due to air flow on the vanes. Such vibrations create surface damage, in the form of a groove, on the slots of the control ring caused by repeated overload. This surface damage is referred to hereinafter as brinelling type wear.

Over time, a groove in the control ring is caused by the brinelling type wear due to the vibration of the vanes from gas flow. The pin translates vibrations from the vanes to a repeated normal force to the side of the slot of the control ring thereby creating the groove. This groove could cause the pin to lock in the slot leading to a failure of the adjustable inlet guide vane mechanism.

Some attempts have been made to reduce vibrations in compressors. U.S. Pat. No. 7,220,098 to Bruce et al. discloses a compressor variable stator vane assembly (200) resistant to wear due to high temperatures and vibration. The surface of the variable stator vane assembly's (200) vane trunnion (350) is covered with a wear coating (360), which is subsequently covered with an antifriction coating (370). These coatings function to prevent wear of the variable stator vane assembly by providing a reduced coefficient of friction, in the range of 0.2 to 0.6. However, this device, while reducing friction between components, does not reduce vibrations between the pin and slot of the control ring caused by a space created therebetween.

Accordingly, a need exists for an adjustable inlet guide vane mechanism for a compressor that reduces the vibrations caused by a space or gap that exists between the slots of a control ring and the pin positioned therein.

SUMMARY OF THE INVENTION

The present invention provides an adjustable inlet guide vane mechanism of a compressor that includes a control ring with a plurality of tapered slots and a plurality of tapered pin/lever assemblies each having a tapered pin configured to be positioned within the tapered slots. This configuration eliminates the space between the slots of the control ring and the pins and ensures contact on both sides of the pin thereby preventing brinelling wear.

More specifically, the present invention is a method to prevent brinelling wear of a slot and pin assembly of an adjustable inlet guide vane mechanism of a compressor. The method includes the steps of: providing the compressor having the adjustable inlet guide vane mechanism including a control ring with a plurality of tapered slots positioned around a circumference of the control ring; providing a plurality of tapered pin/lever arm assemblies each comprising a tapered pin having a tapered body with a first threaded end and a second end, a lever arm extending perpendicularly from the second end of the tapered body of the tapered pin and a vane coupled to an end of the lever arm; positioning the tapered pin of the tapered pin/lever arm assembly within each of the plurality of tapered slots such that the first threaded end of the tapered body of the tapered pin extends through the tapered slot; positioning a washer and spring over the first threaded end of the tapered pin of each of the tapered pin/lever arm assemblies; and securing the tapered pin of each of the tapered pin/lever arm assemblies within each of the tapered slots by coupling a nut to the first threaded end of the tapered pin of each of the tapered pin/lever arm assemblies. The tapered body of the tapered pin of each of the tapered pin/lever arm assemblies and each of the plurality of tapered slots are shaped to ensure contact between the tapered body of the tapered pin and the tapered slot thereby preventing brinelling wear.

The tapered pin/lever arm assemblies and the control ring may be manufactured from a material having a low-coefficient of friction. Alternatively, the tapered pin of each of the tapered pin/lever arm assemblies and the tapered slots of the control ring may be coated with an anti-friction coating.

The spring adjusts may be configured to compensate for wearing due to normal operation in each of the tapered slots. The washer may be cup-shaped to maintain the spring in a correct position. The vanes may be coupled to the lever arm of the tapered pin/lever arm assembly by a bolt.

The present invention is also an adjustable inlet guide vane mechanism. The mechanism includes a control ring having a plurality of tapered slots positioned around a circumference of the control ring; a plurality of tapered pin/lever arm assemblies each comprising a tapered pin having a tapered body with a first threaded end and a second end and a lever arm extending perpendicularly from the second end of the tapered body of the tapered pin; a vane coupled to an end of the lever arm; a washer and spring assembly positioned over the first threaded end of the tapered pin of each of the tapered pin/lever arm assemblies; and a nut threadedly secured to the first threaded end of the tapered pin of each of the tapered pin/lever arm assemblies. The tapered pin of each of the tapered pin/lever arm assemblies is configured to be positioned within each of the plurality of tapered slots such that the first threaded end of the tapered pin extends through the tapered slot. The tapered body of the tapered pin of each of the tapered pin/lever arm assemblies and each of the plurality of tapered slots are shaped to ensure contact between the tapered body of the tapered pin and the tapered slot thereby preventing brinelling wear.

The tapered pin/lever arm assemblies and the control ring may be manufactured from a material having a low-coefficient of friction. Alternatively, the tapered pin of each of the tapered pin/lever arm assemblies and the tapered slots of the control ring may be coated with an anti-friction coating.

The spring adjusts may be configured to compensate for wearing due to normal operation in each of the tapered slots. The washer may be cup-shaped to maintain the spring in a correct position. The vanes may be coupled to the lever arm of the tapered pin/lever arm assembly by a bolt. The first threaded end of the tapered body of the tapered pin of the tapered pin/lever arm assembly may include a groove positioned therein to stop the nut once it has been secured to the first threaded end.

Additionally, the present invention is directed to a compressor that includes a body portion and an adjustable inlet guide vane mechanism coupled to the body portion. The adjustable inlet guide vane mechanism includes a control ring having a plurality of tapered slots positioned around a circumference of the control ring; a plurality of tapered pin/lever arm assemblies each comprising a tapered pin having a tapered body with a first threaded end, and a second end and a lever arm extending perpendicularly from the second end of the tapered body of the tapered pin; a vane coupled to an end of the lever arm; a washer and spring assembly positioned over the first threaded end of the tapered pin of each of the tapered pin/lever arm assemblies; and a nut threadedly secured to the first threaded end of the tapered pin of each of the tapered pin/lever arm assemblies. The tapered pin of each of the tapered pin/lever arm assemblies is configured to be positioned within each of the plurality of tapered slots such that the first threaded end of the tapered pin extends through the tapered slot. The tapered body of the tapered pin of each of the tapered pin/lever arm assemblies and each of the plurality of tapered slots are shaped to ensure contact between the tapered body of the tapered pin and the tapered slot thereby preventing brinelling wear.

The tapered pin/lever arm assemblies and the control ring may be manufactured from a material having a low-coefficient of friction. Alternatively, the tapered pin of each of the tapered pin/lever arm assemblies and the tapered slots of the control ring may be coated with an anti-friction coating.

The spring adjusts may be configured to compensate for wearing due to normal operation in each of the tapered slots. The washer may be cup-shaped to maintain the spring in a correct position. The vanes may be coupled to the lever arm of the tapered pin/lever arm assembly by a bolt. The first threaded end of the tapered body of the tapered pin of the tapered pin/lever arm assembly may include a groove positioned therein to stop the nut once it has been secured to the first threaded end.

These and other features and characteristics of the present invention, as well as the methods of operation and functions of the related elements of structures, and the combination of parts and economies of manufacture, will become more apparent upon consideration of the following description and the appended claims with reference to the accompanying drawings, all of which form a part of this specification, wherein like reference numerals designate corresponding parts in the various figures. As used in the specification and the claims, the singular form of "a", "an", and "the" include plural referents unless the context clearly dictates otherwise.

DETAILED DESCRIPTION OF THE PRESENT INVENTION

Figure 1:
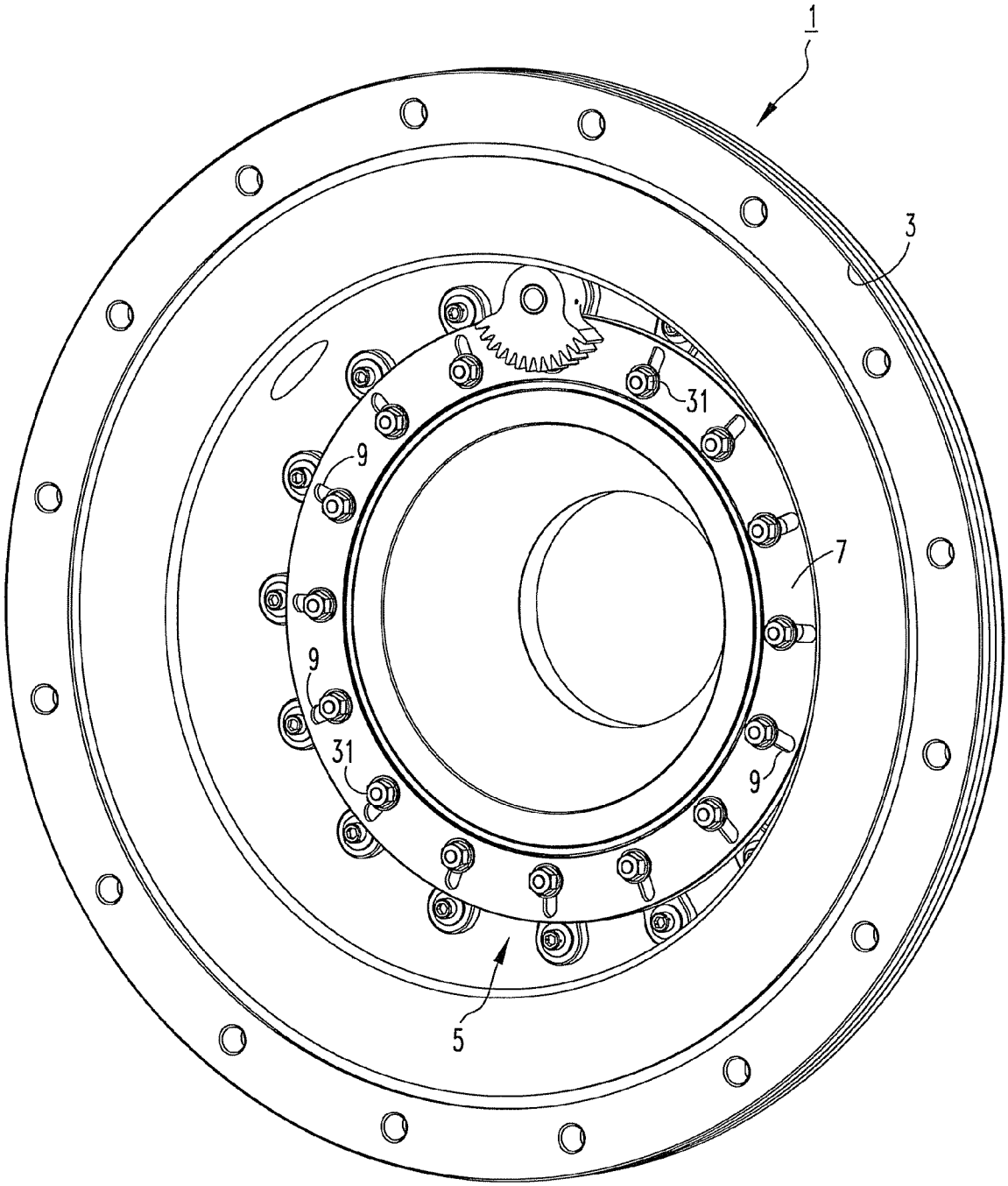
FIG. 1 is a perspective front view of an adjustable inlet guide vane of a compressor in accordance with the present invention.
Figure 2:
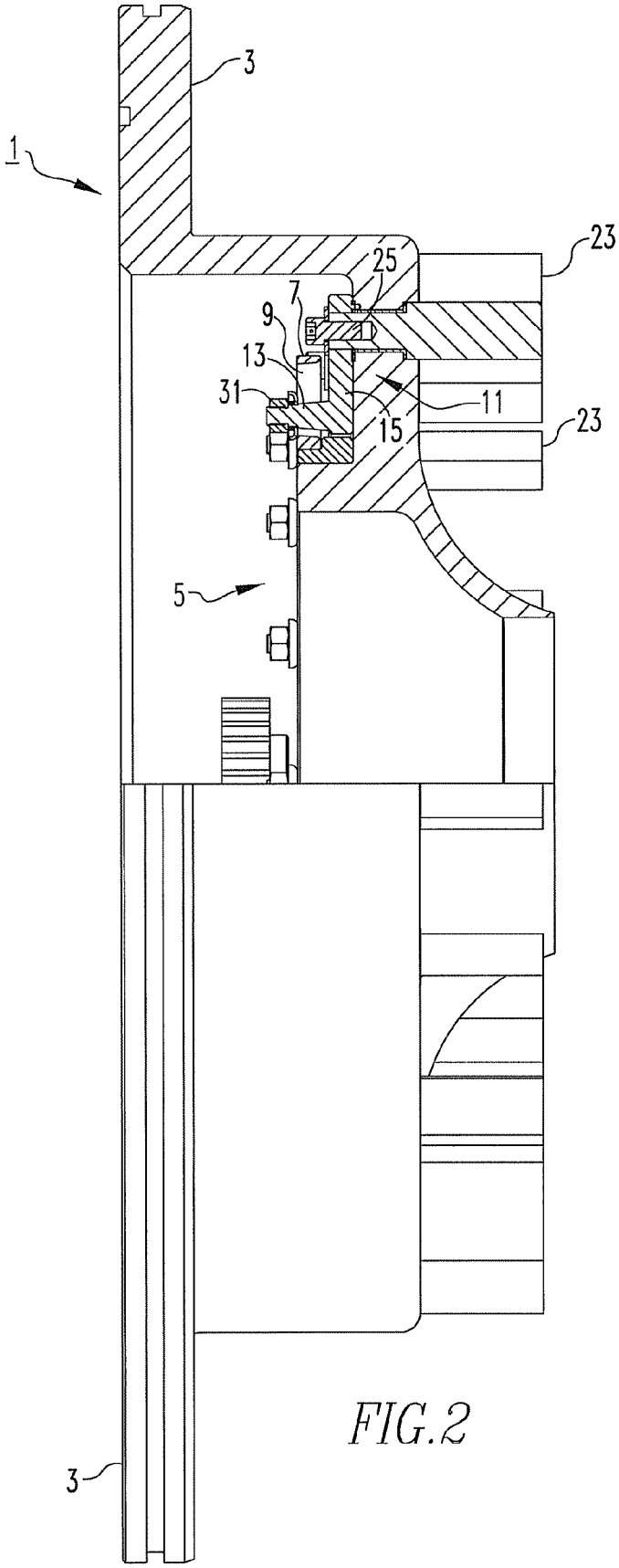
FIG. 2 is a side plan view of the adjustable inlet guide vane of FIG. 1 in partial cross section.
Figure 3:
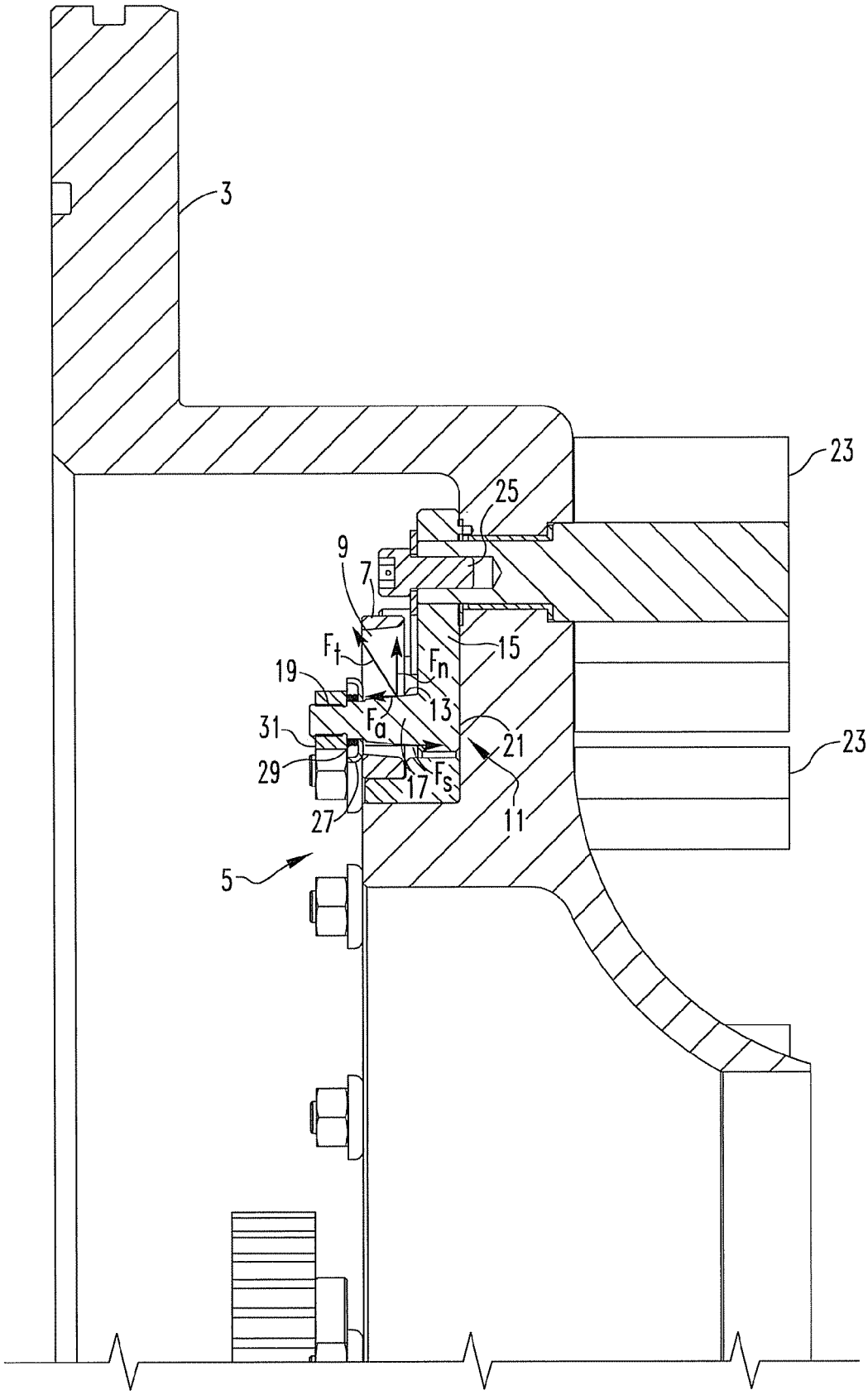
FIG. 3 is a cross-sectional view of a portion of the adjustable inlet guide vane of FIG. 2 enlarged for magnification purposes.
Figure 4:
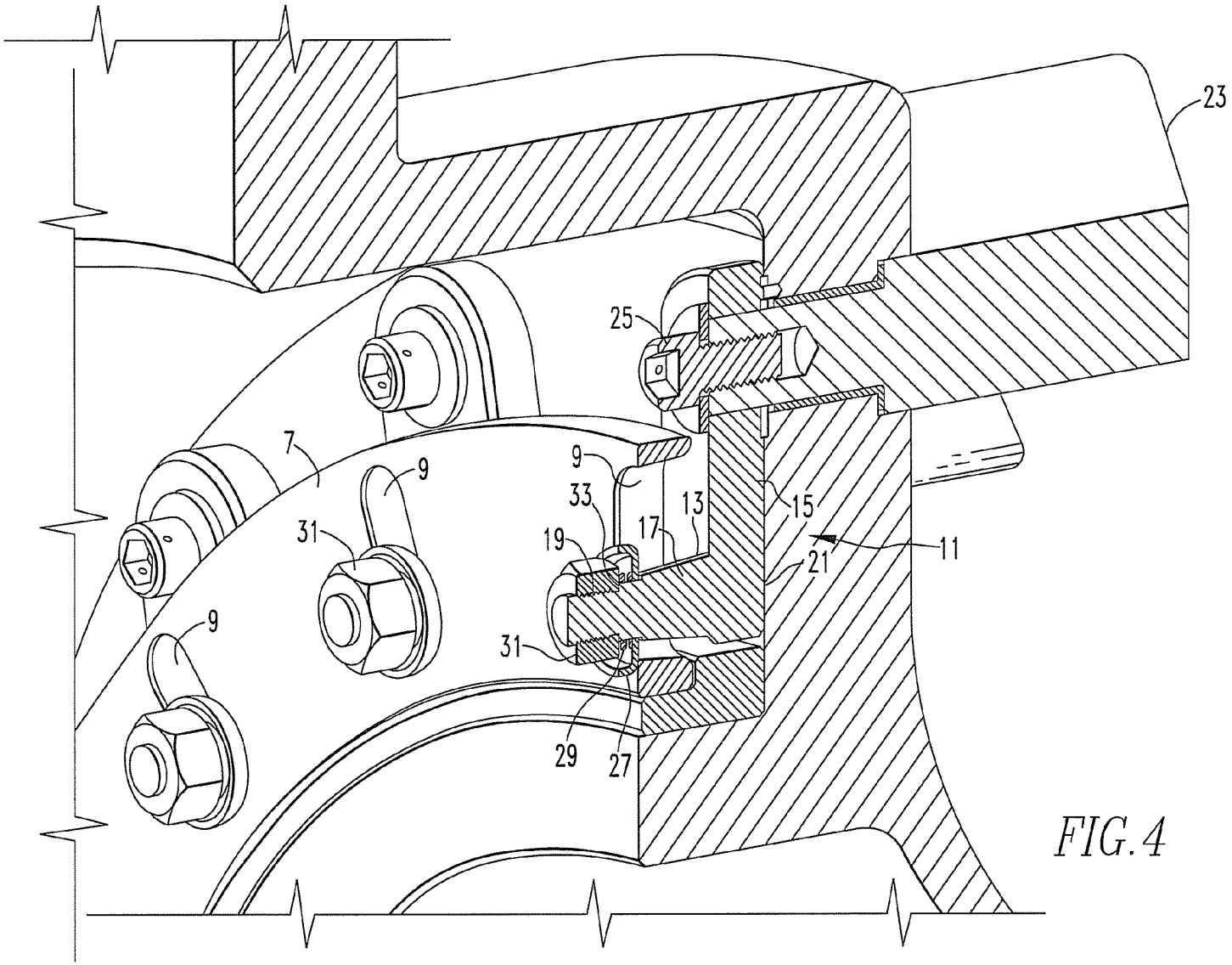
FIG. 4 is a perspective view of cross-sectional view of the adjustable inlet guide vane of FIG. 1 enlarged for magnification purposes.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

With reference to FIGS. 1-4, a compressor 1 includes a body portion 3 and an adjustable inlet guide vane mechanism 5 coupled to body portion 3. Adjustable inlet guide vane mechanism 5 includes a control ring 7 having a plurality of tapered slots 9 positioned around a circumference of control ring 7. Adjustable inlet guide vane mechanism 5 also includes a plurality of tapered pin/lever arm assemblies 11 each comprising a tapered pin 13 and a lever arm 15. Tapered pin 13 has a tapered body 17 with a first threaded end 19 and a second end 21. Tapered pin 13 of each of tapered pin/lever arm assemblies 11 is configured to be positioned within each of the plurality of tapered slots 9 such that first threaded end 19 of tapered pin 13 extends through one of tapered slots 9. Lever arm 15 extends perpendicularly from second end 21 of tapered body 17 of tapered pin 13.

Tapered pin 13 of tapered pin/lever arm assemblies 11 and tapered slots 9 of control ring 7 are designed to have such a taper that no gap exists between the sides of each tapered pin 13 and each tapered slot 9. The elimination of this gap reduces vibration between the pin and slot during operation thereby preventing brinelling type wear. Adjustable inlet guide vane mechanism 5 also includes a plurality of vanes 23. Each vane 23 is coupled to an end of each lever arm 15 of tapered pin/lever arm assemblies 11 by a fastening device 25 such as a bolt. As shown in FIG. 1, control ring 7 may include fifteen tapered slots 9 with tapered pin/lever arm assemblies 11 positioned within each slot 9; however, this is not to be construed as limiting the present invention as control ring 7 may have any suitable number of slots 9 formed therein.

The tapering of pin 13 and slot 9 induces an axial force (illustrated as arrow $F_a$ in FIG. 3) on control ring 7 which would force control ring 7 off of tapered pins 13. Accordingly, to prevent control ring 7 from riding of tapered pins 13, a washer 27 and then a spring 29 are positioned over first threaded end 19 of tapered pin 13 of each of tapered pin/lever arm assemblies 11. Thereafter, a nut 31 is threadedly secured to first threaded end 19 of tapered pin 13 of each of tapered pin/lever arm assemblies 11. Spring 29 is provided to preload control ring 7 to each tapered pin 13. In addition, spring 29 continuously adjusts to accommodate the wearing of tapered slots 9 due to normal operation. First threaded end 19 of tapered body 17 of tapered pin 13 includes a groove 33 formed therein to stop nut 31 once it has been secured to first threaded end 19. Washer 27 is cup-shaped to prevent an edge of washer 27 from gripping control ring 7 and to maintain spring 29 in a correct position.

Spring 29 is held in place between cupped washer 27 and nut 31. As control ring 7 is rotated to adjust the position of vanes 23, spring 29 functions to provide opposing forces to axial force $F_a$ produced by vanes 23, in order to hold pin 13 and control ring 7 together. More specifically, springs 29 are designed such that nut 31 is seated in groove 33 of tapered pin 13 allowing for a minimum spring force (illustrated as arrow $F_s$ in FIG. 3) to maintain proper positioning of control ring 7. Spring force $F_s$ is based off the maximum vane torque created during operation. This vane torque creates a normal force (illustrated as arrow $F_n$ in FIG. 3) pushing against slots 9 that is required for vane rotation. In addition to axial force $F_a$, a normal force component (illustrated as arrow $F_t$ in FIG. 3) is also caused by the taper of the slots 9 and pins 13. Spring 29 is sized to overcome axial force $F_a$ with a margin to maintain contact between slot 9 and pin 13. In addition, axial force $F_a$ is minimized as much as possible by keeping the angle of the taper of slot 9 and pin 13 as small as possible. For instance, the angle of the taper of slot 9 and pin 13 is between about 5° and about 30° dependent upon the amount of contact required to transfer a load from slot 9 to pin 13 effectively.

As discussed above, tapered body 17 of tapered pin 13 of each of tapered pin/lever arm assemblies 11 and each of the plurality of tapered slots 9 are shaped to ensure contact between tapered body 17 of tapered pin 13 and tapered slot 9. Such a configuration ensures contact between tapered pin 13 and tapered slot 9 thereby reducing vibration between these components. This reduction of vibration prevents brinelling type wear.

Tapered pin/lever arm assemblies 11 and control ring 7 are manufactured from a material having a low-coefficient of friction such as, but not limited to, hardened and highly polished steel. Alternatively, tapered pin 13 of each of tapered pin/lever arm assemblies 11 and tapered slots 9 of control ring 7 are coated with an anti-friction coating such as, but not limited to, General Magnaplate Hi-T-Lube Coating, Armoloy TDC 78Rc or any other suitable coating.

In addition, the present invention is directed to a method to prevent brinelling wear of slot 9 and pin 13 of adjustable inlet guide vane mechanism 5 of compressor 1. The method includes the steps of: providing compressor 1 with adjustable inlet guide vane mechanism 5 having control ring 7 with a plurality of tapered slots 9 positioned around circumference of control ring 7. Tapered slots 9 are machined such that the angle of the taper is as small as possible.

Next, a plurality of tapered pin/lever arm assemblies 11 is provided, each comprising a tapered pin 13 having a tapered body 17 with a first threaded end 19 and a second end 21. Tapered pins 13 are also machined such that the angle of the taper is as small as possible. Each tapered pin/lever arm assembly 11 also includes lever arm 15 extending perpendicularly from second end 21 of tapered body 17 of tapered pin 13, and a vane 23 coupled to an end of lever arm 15. Thereafter, tapered pin 13 of tapered pin/lever arm assembly 11 is positioned within each of the plurality of tapered slots 9 such that first threaded end 19 of tapered body 17 of tapered pin 13 extends through tapered slot 9.

Washer 27 and spring 29 are then positioned over first threaded end 19 of tapered pin 13 of each of tapered pin/lever arm assemblies 11, and tapered pin 13 of each of tapered pin/lever arm assemblies 11 is secured within each of tapered slots 9 by coupling nut 31 to first threaded end 19 of tapered pin 13 of each of tapered pin/lever arm assemblies 11. Tapered body 17 of tapered pin 13 of each of tapered pin/lever arm assemblies 11 and each of the plurality of tapered slots 9 are shaped to ensure contact between tapered body 17 of tapered pin 13 and tapered slot 9. Such a configuration ensures contact between tapered pin 13 and tapered slot 9 thereby reducing vibration between these components. This reduction of vibration prevents brinelling type wear.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A method to prevent brinelling wear of a slot and pin assembly of an adjustable inlet guide vane mechanism of a compressor, the method comprising the steps of:

providing the compressor having the adjustable inlet guide vane mechanism including a control ring with a plurality of tapered slots positioned around a circumference of the control ring;

providing a plurality of tapered pin/lever arm assemblies each comprising a tapered pin having a tapered body with a first end and a second end, a lever arm extending perpendicularly from the second end of the tapered body of the tapered pin and a vane coupled to an end of the lever arm;

positioning the tapered pin of the tapered pin/lever arm assembly within each of the plurality of tapered slots such that the first end of the tapered body of the tapered pin extends through the tapered slot;

positioning a spring over the first end of the tapered pin of each of the tapered pin/lever arm assemblies; and securing the tapered pin of each of the tapered pin/lever arm assemblies within each of the tapered slots by coupling a fastening member to the first end of the tapered pin of each of the tapered pin/lever arm assemblies, wherein the tapered body of the tapered pin of each of the tapered pin/lever arm assemblies and each of the plurality of tapered slots are shaped to ensure contact between the tapered body of the tapered pin and the tapered slot thereby preventing brinelling wear, and the spring adjusts to compensate for wearing due to normal operation in each of the tapered slots.

2. The method of claim 1, wherein the tapered pin/lever arm assemblies and the control ring are manufactured from a material having a low-coefficient of friction.

3. The method of claim 1, wherein the tapered pin of each of the tapered pin/lever arm assemblies and the tapered slots of the control ring are coated with an anti-friction coating.

4. The method of claim 1, wherein a cup-shaped washer is provided and positioned over the first end of the tapered pin to maintain the spring in a correct position.

5. The method of claim 1, wherein the vanes are coupled to the lever arm of the tapered pin/lever arm assembly by a bolt.

6. An adjustable inlet guide vane mechanism comprising:

a control ring having a plurality of tapered slots positioned around a circumference of the control ring;

a plurality of tapered pin/lever arm assemblies each comprising a tapered pin having a tapered body with a first end and a second end and a lever arm extending perpendicularly from the second end of the tapered body of the tapered pin, the tapered pin of each of the tapered pin/lever arm assemblies configured to be positioned within each of the plurality of tapered slots such that the first end of the tapered pin extends through the tapered slot;

a vane coupled to an end of the lever arm;

a spring positioned over the first end of the tapered pin of each of the tapered pin/lever arm assemblies; and a fastening member secured to the first end of the tapered pin of each of the tapered pin/lever arm assemblies, wherein the tapered body of the tapered pin of each of the tapered pin/lever arm assemblies and each of the plurality of tapered slots are shaped to ensure contact between the tapered body of the tapered pin and the tapered slot thereby preventing brinelling wear, and the spring adjusts to compensate for wearing due to normal operation in each of the tapered slots.

7. The adjustable inlet guide vane mechanism of claim 6, wherein the tapered pin/lever arm assemblies and the control ring are manufactured from a material having a low-coefficient of friction.

8. The adjustable inlet guide vane mechanism of claim 6, wherein the tapered pin of each of the tapered pin/lever arm assemblies and the tapered slots of the control ring are coated with an anti-friction coating.

9. The adjustable inlet guide vane mechanism of claim 6, wherein a cup-shaped washer is provided and positioned over the first end of the tapered pin to maintain the spring in a correct position.

10. The adjustable inlet guide vane mechanism of claim 6, wherein the vanes are coupled to the lever arm of the tapered pin/lever arm assembly by a bolt.

11. The adjustable inlet guide vane mechanism of claim 6, wherein the first end of the tapered body of the tapered pin of the tapered pin/lever arm assembly includes a groove positioned therein to stop the fastening member once it has been secured to the first end.

12. A compressor comprising:

a body portion; and an adjustable inlet guide vane mechanism coupled to the body portion, the adjustable inlet guide vane mechanism comprising:

a control ring having a plurality of tapered slots positioned around a circumference of the control ring;

a plurality of tapered pin/lever arm assemblies each comprising a tapered pin having a tapered body with a first end and a second end and a lever arm extending perpendicularly from the second end of the tapered body of the tapered pin, the tapered pin of each of the tapered pin/lever arm assemblies configured to be positioned within each of the plurality of tapered slots such that the first end of the tapered pin extends through the tapered slot;

a vane coupled to an end of the lever arm;

a spring positioned over the first end of the tapered pin of each of the tapered pin/lever arm assemblies; and a fastening member secured to the first end of the tapered pin of each of the tapered pin/lever arm assemblies, wherein the tapered body of the tapered pin of each of the tapered pin/lever arm assemblies and each of the plurality of tapered slots are shaped to ensure contact between the tapered body of the tapered pin and the tapered slot thereby preventing brinelling wear, and wherein the spring adjusts to compensate for wearing due to normal operation in each of the tapered slots.

13. The compressor of claim 12, wherein the tapered pin/lever arm assemblies and the control ring are manufactured from a material having a low-coefficient of friction.

14. The compressor of claim 12, wherein the tapered pin of each of the tapered pin/lever arm assemblies and the tapered slots of the control ring are coated with an anti-friction coating.

15. The compressor of claim 12, wherein a cup-shaped washer is provided and positioned over the first end of the tapered pin to maintain the spring in a correct position.

16. The compressor of claim 12, wherein the vanes are coupled to the lever arm of the tapered pin/lever arm assembly by a bolt.

17. The compressor of claim 12, wherein the first end of the tapered body of the tapered pin of the tapered pin/lever arm assembly includes a groove positioned therein to stop the fastening member once it has been secured to the first end.

* * * * *